US007064295B1

(12) United States Patent
Rassatt

(10) Patent No.: US 7,064,295 B1
(45) Date of Patent: Jun. 20, 2006

(54) THERMAL PROCESSOR HAVING FLEXIBLE DUCT

(75) Inventor: Bradley B. Rassatt, West Apple Valley, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/054,828

(22) Filed: Feb. 10, 2005

(51) Int. Cl.
*H05B 11/00* (2006.01)

(52) U.S. Cl. ..... 219/216; 219/486; 219/492; 219/494; 399/67; 399/68; 399/70; 399/324

(58) Field of Classification Search ..... 219/216, 219/486, 492, 494; 399/67–70, 324, 329, 399/338
See application file for complete search history.

(56) References Cited

U.S. PATENT DOCUMENTS 3,914,097 A 10/1975 Wurl
5,231,774 A 8/1993 Kose et al.
5,421,097 A 6/1995 Yamamoto et al.
5,469,238 A * 11/1995 Biegler ..... 396/565
5,568,693 A 10/1996 Van den Bergen et al.
5,790,069 A * 8/1998 McDaniel et al. ..... 347/263
5,895,592 A 4/1999 Struble et al.
6,285,386 B1 9/2001 Suzuki
6,332,279 B1 12/2001 Fukuhori et al.
6,475,266 B1 11/2002 Hayashi et al.
6,735,882 B1 5/2004 Takahashi
2004/0169714 A1 9/2004 Rassatt et al.

* cited by examiner

*Primary Examiner*—Shawntina Fuqua
(74) *Attorney, Agent, or Firm*—Susan L. Parulski

(57) ABSTRACT

A thermal processor including a heated drum assembly for thermally developing an image in an imaging media. Thermal processor includes an enclosure spaced from and forming an oven around heated drum assembly, enclosure having a media entrance, a media exit, and a vent. Thermal processor further includes a condensation trap and a duct positioned external to enclosure and coupled between vent and condensation trap, duct configured to communicate air from oven to condensation trap.

25 Claims, 4 Drawing Sheets

THERMAL PROCESSOR HAVING FLEXIBLE DUCT

FIELD OF THE INVENTION

The present invention relates generally to an apparatus and method for thermally processing an imaging media, and more specifically to an apparatus and method for thermally developing an imaging media employing an external duct for removing airborne contaminants produced during the development process.

BACKGROUND OF THE INVENTION

Photothermographic film generally includes a base material, such as a thin polymer or paper, coated generally on side with an emulsion of heat sensitive materials. Once the film has been subjected to photostimulation (exposed), for example, by light from a laser of a laser imaging system, the resulting latent image is developed through application of heat to the film.

Several types of thermal processor have been developed for heat developing exposed photothermographic film. One type employs a rotating heated drum having multiple pressure rollers positioned around a segment the drum's circumference to hold the film in contact with the drum during development. Another type slides the photothermographic film over flat, heated surfaces or plates. Still another type of processor, commonly referred to as a flat-bed processor, includes multiple rollers spaced to form a generally horizontal transport path that moves the photothermographic film through an oven. Regardless of the type, however, each of these processors typically heats the photothermographic film to a desired processing temperature for a desired duration, commonly referred to as the dwell time, for optimal film development.

Some types of photothermographic film have emulsions that produce gases as the film is heated during the development process. These gases include contaminants, such as fatty acids (FAZ), which may subsequently condense on "cooler" surfaces within the processor. These deposits can accumulate over time and can damage processor components, cause film jams within the processor, and cause visual defects in the developed image. Consequently, processors developing photothermographic films having these types of emulsions often require regular maintenance to address problems resulting from such contaminants, which can be costly and result in processor downtime.

In efforts to reduce such problems, one type of drum processor includes internal ductwork designed to direct gasses out of the processor before the contaminants can condense. The processor includes a hinged cover that can be opened to allow access to the heated drum and pressure rollers for removal of jams and service. To accommodate the opening and closing of the cover, the ductwork is routed through an opening along the hinge line that is sealed by a gasket which is compressed when the cover is closed. However, due to its location along the hinge line, the gasket can sometimes be cooler than other surfaces and, consequently, FAZ tends to condense and accumulate along the gasket. When the cover is opened, accumulated FAZ may loosen and be deposited within the processor. Additionally, over time, the FAZ build-up can restrict air flow through the duct which can result in FAZ condensing on the drum and rollers and heat gradients within the processor which, in-turn, can result in film jams, premature wearing of drum coatings, and image artifacts in developed film.

It is evident that there is a need for improving thermal processors, particularly drum type processors, to reduce problems associated with gaseous contaminants produced during development of photothermographic film.

SUMMARY OF THE INVENTION

In one embodiment, the present invention provides a thermal processor including a heated drum assembly for thermally developing an image in an imaging media. The thermal processor includes an enclosure spaced from and forming an oven around the heated drum assembly, the enclosure having a media entrance, a media exit, and a vent. The thermal processor further includes a condensation trap and a duct positioned external to the enclosure and coupled between the vent and the condensation trap, the duct configured to communicate air from the oven to the condensation trap.

In one embodiment, the present invention provides a thermal processor including a heated drum for thermally developing an image in an imaging media which produces gaseous contaminants during development, and a plurality of rollers spaced about a circumferential segment of the heated drum. The thermal processor also includes a housing substantially enclosing the heated drum and rollers, the housing including a first curved cover and a second curved cover. The first curved cover generally encloses the rollers and the circumferential segment of the heated drum and includes a vent. The second curved cover generally encloses a remaining circumferential segment of the heated drum. The first and second curved covers each have first ends spaced from one another to define an entrance region and second ends spaced from one another to define an exit region. The thermal processor further includes a condensation trap, and a flexible duct external to the housing and coupled between the vent and condensation trap for communicating air from within the housing to the condensation trap.

In one embodiment, the first curved cover includes a hinge proximate to the second end such that the first curved cover can be rotated about the hinge to an open position that enables access to the rollers and heated drum. In one embodiment, the flexible duct comprises a pliable material that bends when the first curved cover is rotated to the open position. In one embodiment, the condensation trap is mounted relative to the hinge such that the flexible duct is positioned substantially above the condensation trap when the first curved cover is in the open position.

In one embodiment, the flexible duct comprises a material having a low thermal conductivity. In one embodiment, an interior of the duct is configured to have a temperature above a threshold temperature during thermal development of the imaging media. In one embodiment, the threshold temperature is defined by a condensation temperature of gaseous contaminants released by the imaging media during thermal development. In one embodiment, the thermal processor further includes a vacuum system coupled to the condensation trap and configured to remove the gaseous contaminants from within the enclosure by drawing ambient air into the enclosure through the entrance region and creating an air flow from the entrance region across the rollers and at least the circumferential segment of the heated drum, and into the condensation trap via the vent and flexible duct.

By exhausting gasses from within the enclosure via externally mounted flexible duct in accordance with the present invention, the internal ductwork and gasket at the hinge line of the upper cover of the enclosure can be eliminated. As a result, air flow restrictions and contaminant problems due to FAZ and other contaminant deposits on the gasket are eliminated. Also, since the flexible duct comprises a material having a low thermal conductivity and is configured to operate at a temperature above the condensation temperature of the gaseous contaminants, a similar FAZ build-up does not occur within the flexible duct. Furthermore, since the flexible duct comprises a flexible material, the thermal processor's enclosure can be easily opened for access and in the process, any loose contaminants that may be present within the flexible duct are directed to the contaminant removal system and away from the heated drum assembly.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
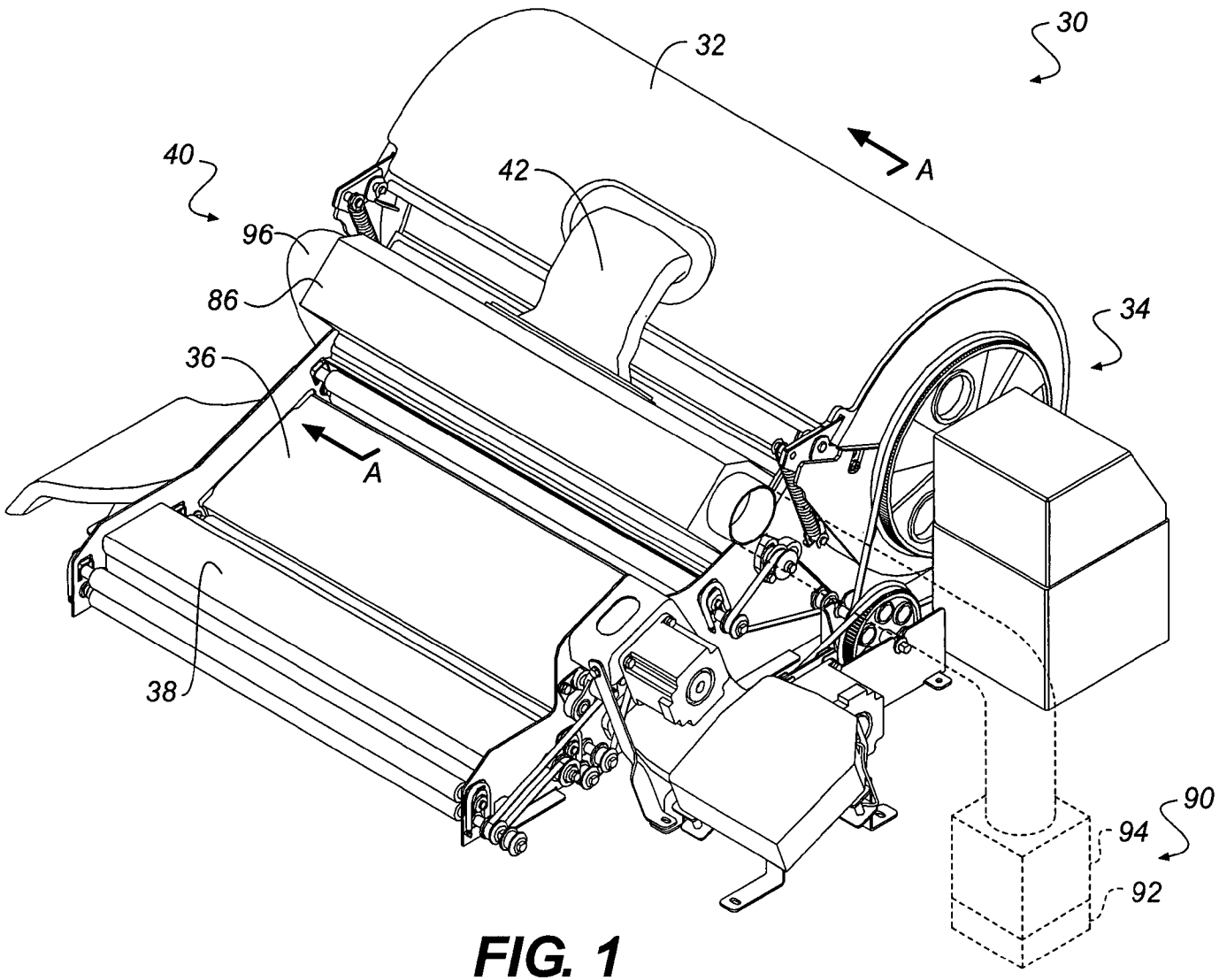
FIG. 1 is a perspective view illustrating generally a thermal processor employing a flex duct in accordance with the present invention.

The following is a detailed description of the preferred embodiments of the invention, reference being made to the drawings in which the same reference numerals identify the same elements of structure in each of the several figures.

FIG. 1 is a perspective view illustrating generally a drum type thermal processor 30 in accordance with the present invention. Thermal processor 30 includes a heated drum assembly 32, a drive system 34, a film cooling section 36, a densitometer 38, and a contaminant removal system 40, with contaminant removal system further including a flexible duct 42 according to one embodiment of the present invention. In operation, exposed photothermographic media is thermally developed by heated drum assembly 32. The heated media is cooled while passing over cooling section 36. Densitometer 38 reads density control patches on the developed media before the developed media is output to a user. Contaminant removal system 40 is configured to remove airborne contaminants, including heated gasses, produced during the thermal development process from heated drum assembly 32 via flexible duct 42.

Figure 2:
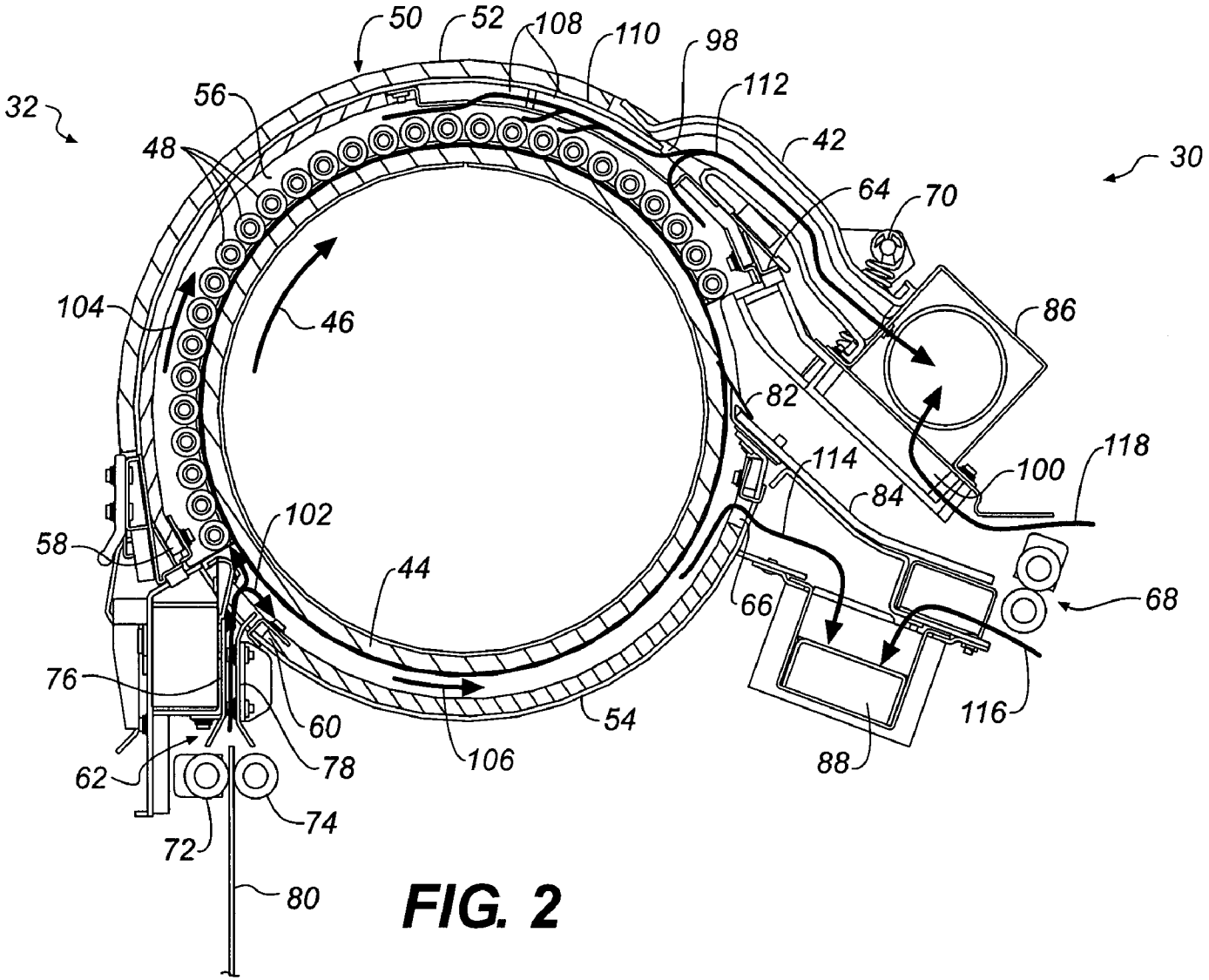
FIG. 2 is a cross-sectional view illustrating in greater detail portions of the thermal processor of FIG. 1.

FIG. 2 is a cross-sectional view illustrating in greater detail portions of thermal processor 30 of FIG. 1. Heated drum assembly 32 includes a heated drum 44 which rotates in a direction 46 as driven by drive assembly 34. Heated drum assembly 32 further includes a plurality of pressure rollers 48 circumferentially arrayed about a segment of drum 44 and configured to hold an exposed media in contact with drum 44 during development. An enclosure 50, including an upper curved cover 52 spaced from pressure rollers 48 and a lower curved cover 54 spaced from a lower portion of drum 44, enclose and form an oven 56 around drum 44 and pressure rollers 46.

Upper and lower covers 52 and 54 have respective first ends 58 and 60 spaced from one another to define a media (film) entrance region 62, and respective second ends 64 and 66 forming a media (film) exit region 68. Upper cover 52 can be rotated around a hinge 70 so that enclosure 50 can be opened to allow access to heated drum 44 and pressure rollers 48.

Feed rollers 72, 74 and entrance guides 76, 78 feed an exposes media 80 into contact with heated drum 44. The rotation of heated drum 44 draws exposed media 80 under pressure rollers 48 and transports exposed media 80 from entrance region 62 to exit region 68. A film diverter 82 diverts exposed media 80 from contact with drum 44 to exit region 68 over a perforated felt pad 84.

In addition to flexible duct 42, contaminant removal system 40 further includes an upper condensation trap 86, a lower condensation 88, and a vacuum system 90 (as indicated by the dashed lines in FIG. 1). Vacuum system 90 is coupled to upper condensation trap 86 and further includes a fan 92 and a filter 94. A rubber hose 96 connects lower condensation trap 88 to upper condensation trap 86.

Flexible duct 42 is coupled between a vent 98 in upper curved cover 52 and upper condensation trap 86. In one embodiment, flexible duct 42 comprises a material having low thermal conductivity characteristics. In one embodiment flexible duct 42 comprises a flexible material, such as a rubber material. In one embodiment, flexible duct 42 comprises an EPDM rubber (ethylene propylene with a diene monomer attached). In one embodiment, flexible duct 42 comprises an EPDM material having a minimum wall thickness of 2.5 millimeters. An example of one suitable EPDM material is Chardon 53237 as manufactured by the Chardon Rubber Company, 373 Washington Street, Chardon, Ohio 44024.

In one embodiment, contaminant removal system 40 further includes an intake duct 100 positioned between condensation trap 86 and heated drum assembly 32 and exit region 68. Intake duct 100 is configured to direct external ambient air to upper condensation trap 86. In one embodiment, as illustrated, intake duct 100 extends the length of upper condensation trap 86 and, in addition to directing ambient air to upper condensation trap 86, is configured to thermally isolate upper condensation trap 86 from heated drum assembly 32 and exit region 68. In one embodiment, intake duct 100 comprises a material having low thermal conductivity characteristics. In one embodiment, intake duct 100 comprises a plastic material, such as a polycarbonate material. A system similar to that described above with regard the condensation traps and vacuum system is described by U.S. patent application Ser. No. 10/376,547 entitled "Contaminant Removal System in a Thermal Processor", which is assigned to the same assignee as the present application and is herein incorporated by reference.

During operation, drum 44 is heated to a desired temperature necessary to provide a uniform development temperature to the particular type of media being developed. For example, for photothermographic medical film drum 44 operates at a temperature of approximately 122.5° C. In one embodiment, drum 42 is heated by a circumferentially uniform resistive heater (not shown) mounted within drum 44. Drum 44 heats pressure rollers 48, oven 58, and other components of thermal processor 30.

Feed rollers 72, 74 receive a piece of exposed media, such as exposed media 80, at an ambient temperature and from a nip to feed exposed media 80 to heated drum 44 via entrance guides 76, 78. Photothermographic film, such as exposed media 80, generally comprise a base material, such as a thin polymer or paper, which is typically coated on one side with an emulsion of heat sensitive materials. As exposed media 80 enters oven 56 and begins to wrap around drum 44, exposed media 80 begins to be heated to the desired development temperature. Some types of photothermographic film have emulsions that produce gasses as the film is heated. These gasses include contaminants, FAZ in particular, which may subsequently condense on surfaces within thermal processor 30, such as drum 44 and pressure rollers 48. These condensed contaminants can become deposited on the film, potentially resulting in image artifacts, and can damage to components of thermal processor 30.

To remove these gaseous contaminants, fan 92 of vacuum system 90 creates a vacuum that draws ambient air into oven 56 via entrance region 62, as indicated by air flow arrows 102 in FIG. 2. Air flow 102 is separated into a top flow stream 104 and a bottom flow stream 106 which are separated by entrance region 62 and exit region 68. Top flow stream 104 is drawn across pressure rollers 48 and is drawn into flexible duct 42 via vent 98 and slotted openings 108 in a vent plate 110 and ultimately communicated to upper condensation trap 86, as indicated by air flow 112. Vent plate 108 is positioned across vent 98 and separates top flow stream 104 to maximize air flow over pressure rollers 48 and to minimize any air that may be pulled over exposed media 80 at exit region 68, which could be a potential source of image artifacts. In one embodiment, as illustrated by FIG. 2, vent 98 is positioned between exit region 68 and entrance region 62 at a location along upper curved cover 52 that results in the most efficient air flow across drum 44 and pressure rollers 48.

During operation, flexible duct 42 becomes internally heated to a temperature above the condensation temperature of the gaseous contaminants produced by exposed media 80 during development. In one embodiment, flexible duct 42 is internally heated to a temperature in a range from 180 to 200 degrees Fahrenheit. In one embodiment, flexible duct 42 is heated to a temperature substantially equal to 180 degrees Fahrenheit. Since flexible duct 42 comprises a material having low thermal conductivity characteristics, it transfers only small amounts of thermal energy to its surrounding environment and, thus, generally remains at a temperature above the condensation temperature during operation. Therefore, as gaseous contaminants are transferred through flexible duct 42 to upper condensation trap via air flow 112, the gaseous contaminants do not condense within flexible duct 42.

Bottom air stream 106 flows across rotating drum 44 between drum 44 and lower curved cover 54 and is drawn into lower condensation trap 88 as indicated by air flow 114. Air flows 106 and 114 remove gases and contaminants from drum 48 and the lower portion of enclosure 50.

Vacuum system 90 via entrance region 62 draws an ambient air flow 116 into low condensation trap 88, and an ambient air flow 118 into upper condensation trap 86 via intake duct 100. Within lower condensation trap 88, ambient air flow 116 mixes with heated air flow 114 causing the gasses to cool and FAZ and other contaminants contained therein to condense and be trapped within lower condensation trap 88. Within upper condensation trap 86, ambient air flow 118 mixes with the heated air flow 112 causing the gasses to cool and FAZ and other contaminants contained therein to condense and be trapped within upper condensation trap 86. It should also be noted that drawing ambient air flow 118 through intake duct 100 cools intake duct 100 and therefore assists in thermally insulating upper condensation trap 86 from heated drum assembly 32 and exit region 68.

Figure 3:
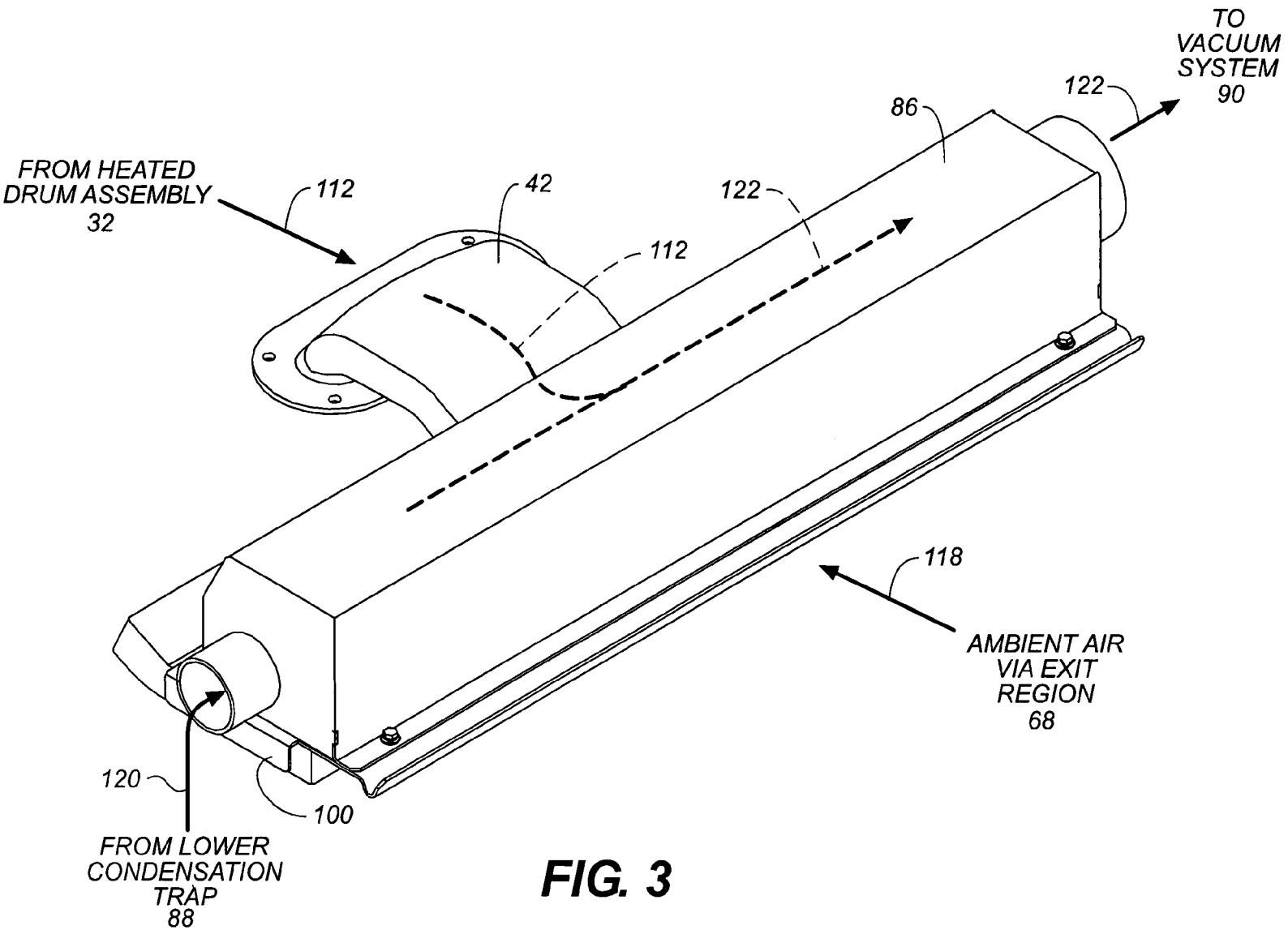
FIG. 3 is an enlarged perspective view illustrating in greater detail a portion of the thermal processor illustrated by FIG. 1.

FIG. 3 is an enlarged perspective view of thermal processor 30 further illustrating flexible duct 42, upper condensation trap 86, and intake duct 100. As illustrated, vacuum system 90 draws an air flow 120 from lower condensation trap 88 into upper condensation trap 86 via rubber hose 96. Air flow 120 is combined with air flows 112 and 118 to form and air flow 122. Air flow 122 is drawn through filter 94 to remove any remaining contaminants and to remove gaseous products.

Figure 4:
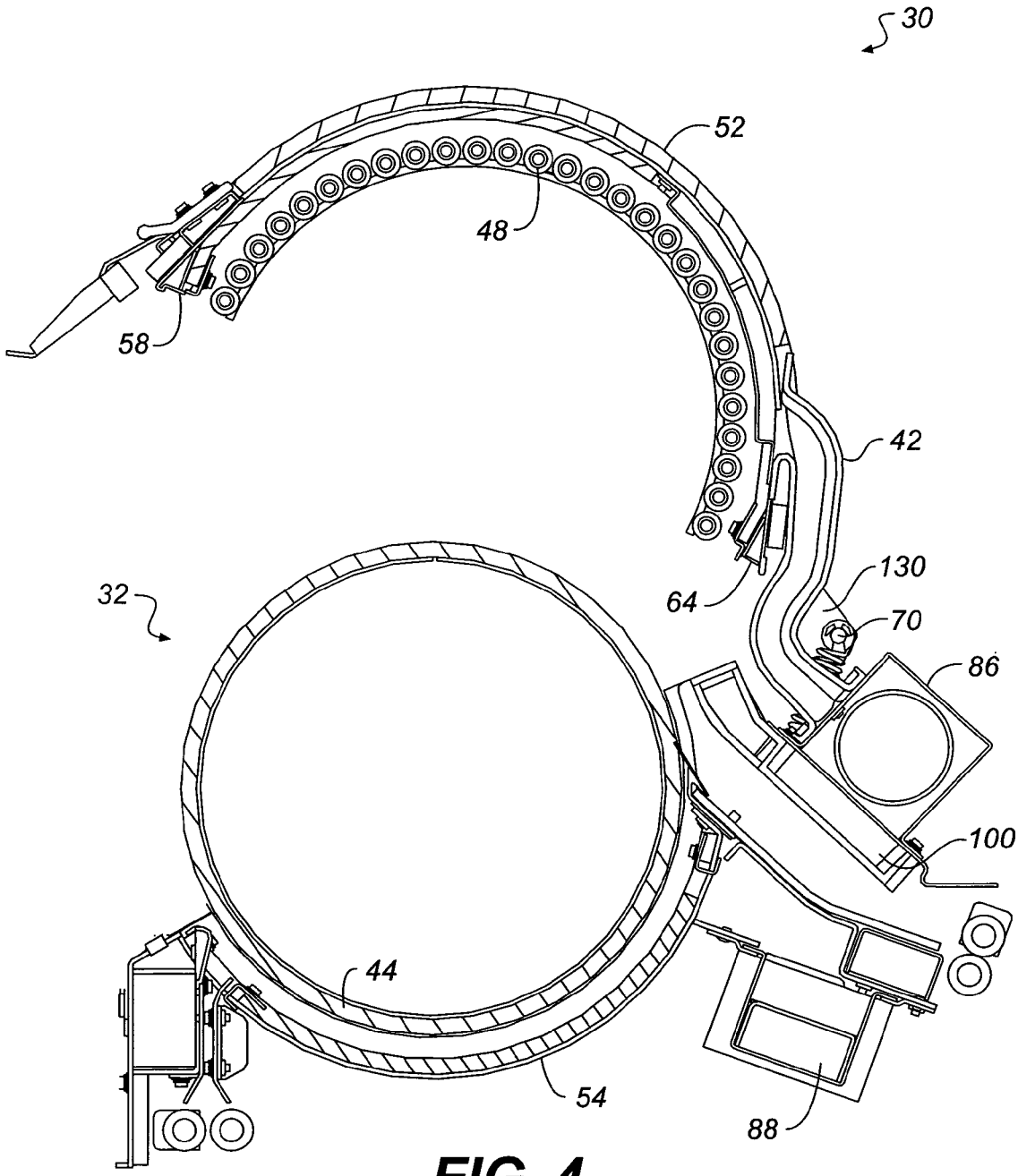
FIG. 4 is a cross-sectional view illustrating the thermal processor illustrated by FIG. 1.

FIG. 4 is a cross-sectional view of thermal processor 30 illustrating upper curved cover 52 in an open position so as to allow access to drum 44 and pressure rollers 46. As illustrated at 130, flexible duct 42 flexes and rotates to a generally vertical position to allow upper curved cover 52 to be opened. As duct 42 flexes, FAZ or other contaminants that may have condensed or otherwise become deposited within duct 42 may become dislodged. However, since flexible duct 42 is in a generally vertical position, any dislodged particles simply fall into upper condensation trap 86, which is positioned generally below flexible duct 42 relative to hinge 70.

In summary, by exhausting gasses from heated drum assembly 32 via externally mounted flexible duct 42 in accordance with the present invention, the internal ductwork and gasket at the hinge line of the upper cover of the thermal processor's enclosure can be eliminated. As a result, air flow restrictions and contaminant problems due to FAZ and other contaminant deposits on the gasket are eliminated. Also, since flexible duct 42 comprises a material having a low thermal conductivity, a similar FAZ build-up does not occur within flexible duct 42. Furthermore, since flexible duct 42 comprises a flexible material, the thermal processor's enclosure can be easily opened for access and in the process, any loose contaminants that may be present within flexible duct 42 are directed to the contaminant removal system (which is located generally below flexible duct 42) and away from the heated drum assembly.

All documents, patents, journal articles and other materials cited in the present application are hereby incorporated by reference.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

| PARTS LIST | |
|---|---|
| 30 | Thermal Processor |
| 32 | Heated Drum Assembly |
| 34 | Drive System |
| 36 | Film Cooling Section |
| 38 | Densitometer |
| 40 | Contaminant Removal System |
| 42 | Flexible Duct |
| 44 | Heated Drum |
| 46 | Directional Arrow |
| 48 | Pressure Rollers |
| 50 | Enclosure |
| 52 | Upper Cover |
| 54 | Lower Cover |
| 56 | Oven |
| 58, 60 | First Ends |
| 62 | Entrance Region |
| 64, 66 | Second Ends |

-continued

| PARTS LIST | |
|---|---|
| 68 | Exit Region |
| 70 | Hinge |
| 72, 74 | Feed Rollers |
| 76, 78 | Entrance Guides |
| 80 | Media |
| 82 | Film Diverter |
| 84 | Perforated Felt Pad |
| 86 | Upper Condensation Trap |
| 88 | Lower Condensation Trap |
| 90 | Vacuum System |
| 92 | Fan |
| 94 | Filter |
| 96 | Rubber Hose |
| 98 | Vent |
| 100 | Intake Duct |
| 102 | Air Flow - Entrance Region |
| 104 | Air Flow - Top |
| 106 | Air Flow - Bottom |
| 108 | Slotted Openings |
| 110 | Vent Plate |
| 112 | Heated Air Flow - Upper |
| 114 | Heated Air Flow - Lower |
| 116 | Ambient Air Flow - Lower |
| 118 | Ambient Air Flow - Upper |
| 120 | Air Flow |
| 122 | Combined Air Flow |
| 130 | Flex Location |

What is claimed is:

1. A thermal processor comprising:

a heated drum assembly for thermally developing an image in an imaging media;

an enclosure spaced from and forming an oven around the heated drum assembly, the enclosure having a media entrance, a media exit, and a vent;

a condensation trap positioned external to the enclosure; and a duct positioned external to the enclosure and coupled between the vent and the condensation trap, the duct configured to communicate air from the oven to the condensation trap.

2. A thermal processor comprising:

a heated drum assembly for thermally developing an image in an imaging media;

an enclosure spaced from and forming an oven around the heated drum assembly, the enclosure having a media entrance, a media exit, and a vent;

a condensation trap; and a duct positioned external to the enclosure and coupled between the vent and the condensation trap, the duct configured to communicate air from the oven to the condensation trap;

wherein the duct comprises a material having low thermal conductivity characteristics.

3. The thermal processor of claim 1, wherein the duct comprises a pliable material.

4. The thermal processor of claim 1, wherein flexible duct comprises rubber.

5. The thermal processor of claim 4, wherein the rubber comprises an ethylene propylene with a diene monomer attached (EPDM).

6. A thermal processor comprising:

a heated drum assembly for thermally developing an image in an imaging media;

an enclosure spaced from and forming an oven around the heated drum assembly, the enclosure having a media entrance, a media exit, and a vent;

a condensation trap; and a duct positioned external to the enclosure and coupled between the vent and the condensation trap, the duct configured to communicate air from the oven to the condensation trap;

wherein an interior of the duct is configured to have a temperature above a threshold temperature during thermal development of the imaging media.

7. The thermal processor of claim 6, wherein the threshold temperature is defined by a condensation temperature of gaseous contaminants released by the imaging media during thermal development.

8. The thermal processor of claim 1, wherein an interior of the duct is configured to have a temperature in a range from 180 degrees Fahrenheit to 200 degrees Fahrenheit.

9. The thermal processor of claim 1, further comprising a vacuum system configured to draw heated air from the within the oven into the condensation trap via the vent and duct.

10. A thermal processor comprising:

a heated drum for thermally developing an image in an imaging media which produces gaseous contaminants during development;

a plurality of rollers spaced about a circumferential segment of the heated drum;

a housing substantially enclosing the heated drum and rollers, the housing including:

a first curved cover generally enclosing the rollers and the circumferential segment of the heated drum and having a vent; and a second curved cover generally enclosing a remaining circumferential segment of the heated drum, the first and second curved covers each having first ends spaced from one another to define an entrance region and second ends spaced from one another to define an exit region;

a condensation trap external to the housing; and a flexible duct external to the housing and coupled between the vent and condensation trap for communicating air from within the housing to the condensation trap.

11. The thermal processor of claim 10, wherein the vent is positioned between an apex of the first curved cover and the second end of the first cover.

12. The thermal processor of claim 10, wherein the first curved cover includes a hinge proximate to the second end such that the first curved cover can be rotated about the hinge to an open position that enables access to the rollers and heated drum.

13. The thermal processor of claim 12, wherein the flexible duct comprises a pliable material such that bends when the first curved cover is rotated to the open position.

14. The thermal processor of claim 12, wherein the condensation trap is mounted relative to the hinge such that the flexible duct is positioned substantially above the condensation trap when the first curved cover is in the open position.

15. The thermal processor of claim 10, further comprising:

a heat shield positioned between the condensation trap and the housing for thermally isolating the condensation trap from the heated drum.

16. The thermal processor of claim 15, wherein the heat shield comprises a material having low thermal conductivity characteristics.

17. The thermal processor of claim 15, wherein the heat shield comprises a polycarbonate material.

18. The thermal processor of claim 12, wherein the heat shield forms an intake duct for communicating ambient air to the condensation trap.

19. The thermal processor of claim 10, further comprising a vacuum system coupled to the condensation trap and configured remove the gaseous contaminants from within the enclosure by drawing ambient air into the enclosure through the entrance region and creating an air flow from the entrance region across the rollers and at least the circumferential segment of the heated drum, and into the condensation trap via the vent and flexible duct.

20. The thermal processor of claim 19, wherein during thermal development of the imaging media, an interior of the flexible duct is configured to be at a temperature above a condensation temperature of the gaseous contaminants.

21. The thermal processor of claim 19, wherein during thermal development of the imaging media, an interior of the flexible duct is configured to be substantially within a temperature in a range from 180 to 200 degrees Fahrenheit.

22. The thermal processor of claim 19, wherein during thermal development of the imaging media, the vacuum system further draws ambient air into the condensation trap such that the temperature of the condensation trap is at or below a condensation temperature of the gaseous contaminants so that the gaseous contaminants received via the flexible duct condense in the condensation trap.

23. A method of operating a thermal processor for heat developing a media which produces gaseous contaminants during development, the method comprising:

providing a heated drum enclosed within a housing having a bottom cover and a hinged top cover that can be rotated to an open position that enables access to the heated drum;

providing a flexible duct external to the housing from the top cover to a condensation trap;

maintaining an internal temperature of the flexible duct above a condensation temperature of the gaseous contaminants;

maintaining the condensation trap at a temperature below the condensation temperature of the gaseous contaminants;

creating an air flow that draws the gaseous contaminants from within the enclosure to the condensation trap via the flexible duct; and condensing the gaseous contaminants with the condensation trap.

24. The method of claim 23, further comprising:

positioning the condensation trap such that the condensation trap is generally below the flexible duct when the top cover is in the open position.

25. The method of claim 23, further comprising:

isolating the condensation trap thermally from the heated drum and housing.

* * * * *